US008146880B2

(12) United States Patent
Cheddie

(10) Patent No.: US 8,146,880 B2
(45) Date of Patent: Apr. 3, 2012

(54) APPARATUS FOR REMOVING/INSTALLING A WINDOW SASH

(76) Inventor: Daniel Aaron Cheddie, Hertfordshire (GB)

( * ) Notice: Subject to any disclaimer, the term of this patent is extended or adjusted under 35 U.S.C. 154(b) by 1348 days.

(21) Appl. No.: 11/570,846

(22) PCT Filed: Jun. 6, 2005

(86) PCT No.: PCT/GB2005/002219

§ 371 (c)(1),
(2), (4) Date: Dec. 18, 2006

(87) PCT Pub. No.: WO2005/124056

PCT Pub. Date: Dec. 29, 2005

(65) Prior Publication Data

US 2008/0134626 A1 Jun. 12, 2008

(30) Foreign Application Priority Data

Jun. 22, 2004 (GB) ..... 0413903

(51) Int. Cl.
*E05F 3/00* (2006.01)

(52) U.S. Cl. ..... 248/540; 248/124.2; 248/230.1; 49/70

(58) Field of Classification Search ..... 248/230, 248/540, 124.2, 227.3, 230.1, 231.85, 316.6, 248/122.1, 125.1, 230.2; 49/70, 394
See application file for complete search history.

(56) References Cited

U.S. PATENT DOCUMENTS

| | | | | |
|---|---|---|---|---|
| 2,364,224 | A | 12/1944 | Keller | |
| 2,514,397 | A | 7/1950 | Joyce | |
| 2,652,937 | A | 9/1953 | Cutler | |
| 3,712,482 | A * | 1/1973 | Bondowski | 414/11 |
| 3,949,525 | A * | 4/1976 | Bates et al. | 49/395 |
| 5,683,066 | A * | 11/1997 | McCann | 248/295.11 |
| 5,927,664 | A * | 7/1999 | Schmidt | 248/176.1 |
| 6,293,058 | B1 * | 9/2001 | Sink | 52/127.1 |
| 6,758,448 | B1 * | 7/2004 | Williams et al. | 248/125.1 |
| 7,001,464 | B1 * | 2/2006 | Erdman et al. | 118/305 |

FOREIGN PATENT DOCUMENTS

| | | | |
|---|---|---|---|
| DE | 19605178 | A1 | 8/1997 |
| FR | 1400614 | A | 5/1965 |
| FR | 2816973 | A | 5/2002 |
| WO | 88/01670 | | 3/1988 |

* cited by examiner

*Primary Examiner* — Terrell McKinnon
*Assistant Examiner* — Steven Marsh
(74) *Attorney, Agent, or Firm* — Brooks Kushman P.C.

(57) ABSTRACT

An apparatus for supporting a window sash (54) has clamps (14, 16) for clamping the support apparatus to a frame unit (52) of a window assembly (50) and support arms (42) mounted on the support apparatus for supporting the window sash (54) in an open position relative to the frame unit (52). The apparatus has the advantage that it allows a window sash of the type that opens outwardly of a building to be removed and/or installed from the interior of the building.

7 Claims, 2 Drawing Sheets

APPARATUS FOR REMOVING/INSTALLING A WINDOW SASH

The invention relates to an apparatus for removing and/or installing a window sash and particularly, but not exclusively, to replacing double glazed window sashes.

A window assembly normally comprises a suitably shaped window frame unit that is fixedly secured in an opening of a building or the like and at least one window sash that is mounted in or on the window frame unit and is operable to be moved between open and closed positions with respect to the frame unit for admitting light and/or air to the building. The window sash normally comprises a sash frame through which the sash is mounted in or on the frame unit and which defines an opening for receiving a window pane.

Historically, window frame units and sash frames of window assemblies have been manufactured from wood with a windowpane being received in the opening of the sash frame and secured in place by fixture means comprising nails, putty or the like arranged around the circumference of the sash frame opening. In the event that the windowpane is damaged, i.e. broken or cracked, the window sash can be re-glazed in situ by removing the fixture means, removing whatever remains of the damaged pane, installing a replacement pane and reapplying the or new fixture means.

Many modern window assemblies, however, comprise what are commonly referred to as "double glazed windows". The frame units and sash frames of these window assemblies are often constructed from an assembly of unplasticized polyvinyl chloride (uPVC) extruded member sections although sections of extruded members of other materials such as metal, e.g. aluminium, are also commonly used. The window sash of such an assembly typically comprises an assembly of four uPVC extruded member frame sections heat welded, glued or otherwise fixed together to form a generally rectangular sash frame which surrounds and engages through water seals edge portions of a windowpane unit comprising a sealed arrangement of two spaced apart panes enclosing a partial vacuum. Such window sashes are normally heavier than single pane window sashes and so are more difficult to manually handle when being removed from an installed window assembly. Single pane window sashes can also be assembled in a similar manner from extruded member frame sections.

In many window assemblies, the window sash is arranged to swing open with respect to the frame unit such that a lower edge part of the window sash is spaced considerably further away from the frame unit than an upper edge part of the sash when in its open position. This opening arrangement is normally facilitated by respective mechanical linkages (pivot assemblies) secured between upper portions of side members of the sash frame and side members of the frame unit.

Single and double glazed window assemblies assembled from extruded member frame sections are commonly manufactured in workshops, factories or the like ready for shipping and installation as complete units. Where a window pane of such a window sash in an already installed window assembly is damaged, it is common practice for the damaged window sash to be removed and replaced by a replacement sash unit. This is because the window sash is normally constructed as a unit that is not designed to be disassembled in situ or at all and also because, in the case of double glazed units, it is difficult to restore in situ the partial vacuum that must exist between the two spaced apart panes of a re-glazed, double glazed windowpane unit.

Removal or installation of a window sash from an installed window assembly is often a two person task requiring one person to hold the window sash in an open position whilst the second person releases from or secures to the frame unit or the sash the mechanical linkages by which the sash is mounted to the frame unit. This problem is exacerbated for installed window assemblies having sashes that are operable to open outwardly of a building and further exacerbated when the window assembly is installed in a floor of the building above ground level. In this case, it is then often necessary to utilise scaffolding or employ a mechanised hoist to gain access to the exterior of the window assembly in addition to the interior for removal/installation of such an outwardly opening window sash.

It is therefore an object of the present invention to provide an apparatus that obviates and/or mitigates disadvantages associated with conventional methods of removing and/or installing window sashes from/in already installed window assemblies.

It is another object of the present invention to provide an apparatus that allows a window sash of the type that opens outwardly of a building to be removed and/or installed from the interior of the building.

It is a further object of the present invention to provide an apparatus that allows a single person to effect removal and/or installation of a window sash from/in an already installed window assembly.

According to a first aspect of the present invention, there is provided an apparatus for supporting a window sash comprising:

means for clamping the support apparatus to a frame unit of a window assembly; and means mounted on the support apparatus for supporting the window sash in an open position relative to the frame unit.

The support apparatus thereby provides a means of supporting the window sash in an open position relative to the window assembly frame unit such that a user can access the means (mechanical linkages) by which the window sash is mounted to the frame unit to release such means. The user can then remove the window sash from the already installed window assembly by lifting it from the support apparatus support means on which it is now being supported.

Advantageously, the support apparatus can also be employed to support a new or replacement window sash in an open position relative to the window assembly frame unit to enable a user to secure the sash mounting means to the frame unit when installing a new or replacement window sash in situ.

Preferably, the support apparatus comprises an elongate support member which, in use, is clamped by the clamp means to a frame unit of a window assembly in a generally vertical orientation.

The clamp means may comprise a first clamp element located adjacent one end of the elongate support member and a second clamp element spaced from said first clamp element and mounted on the elongate support member such that it is moveable with respect to the first clamp element.

This allows the support apparatus to be used with frame units of many different sizes The or each of the first and second clamp elements may comprise a C-section member for engaging a peripheral lip part of a window assembly frame unit.

Preferably, the means for supporting a window sash in an open position relative to the frame unit of a window assembly is movable relative to the support apparatus such that a window sash can be lowered onto or raised from a support platform part of said support means.

This allows a sash frame being either removed from or installed in a frame unit of a window assembly to be more easily handled by a single person thus further negating the need for the removal or installation procedure to be performed by two persons.

Preferably, the means for supporting a window sash in an open position relative to the frame unit of a window assembly comprises a first sash frame engagement means for engaging an upper part of a sash frame and a second sash frame engagement means for engaging a lower part of a sash frame, said first and second sash frame engagement means co-operating to support the sash frame in an open position relative to the frame unit.

Preferably, both said first and second sash frame engagement means are moveable relative to the support apparatus in order to enable the support means to be moved relative to the support apparatus such that a window sash can be lowered onto or raised from the support platform part of said support means.

Preferably, the support apparatus comprises a pair of elongate support members, each of which includes respective first and second clamp elements and first and second sash frame engagement means, wherein each said elongate support member is arranged to be separately clamped to a window assembly frame unit by its respective clamp elements.

A further advantage offered by the apparatus of the present invention is that the apparatus can be operated by a single user and a yet further advantage is that it can be operated by the single user from an interior side (with respect to a building) of an installed window assembly.

According to a second aspect of the present invention, there is provided a method of removing a window sash from a window assembly, comprising the steps of:

clamping a support apparatus to a frame unit of the window assembly, said support apparatus having means for supporting a window sash in an open position relative to the frame unit;

adjusting the support means to support the window sash in said open position;

releasing mounting means by which the window sash is mounted to the frame unit; and removing the window sash from the support means.

The support apparatus can then be removed or left in place to be used in the installation of a replacement window sash.

Preferably, the method includes the step of lowering the released window sash onto a platform part of the support means prior to the step of removing the window sash from said support means.

Preferably, the method includes clamping separate support apparatuses on either side of the window assembly frame unit and operating the support apparatuses simultaneously to remove the window sash from the window assembly.

According to a third aspect of the present invention, there is provided a method of installing a window sash in a window assembly, comprising the steps of:

clamping a support apparatus to a frame unit of the window assembly, said support apparatus having means for supporting a window sash;

placing a window sash on said support means;

adjusting the support means to support the window sash in an open position relative to the frame unit; and securing mounting means between the window sash and frame unit.

The support means can then be readjusted to no longer support the window sash which is now mounted to the window assembly frame unit.

The support apparatus can then be removed from the frame unit.

Preferably, the method includes the step of adjusting the support means includes raising the window sash from a platform part of the support means prior to the step of securing the mounting means between the window sash and frame unit.

Preferably, the method includes clamping separate support apparatuses on either side of the window assembly frame unit and operating the support apparatuses simultaneously to install the window sash in the window assembly.

The foregoing and further features of the present invention will be more readily understood from the following description of a preferred embodiment, by way of example thereof, with reference to the accompanying drawings, of which:

Figure 1:
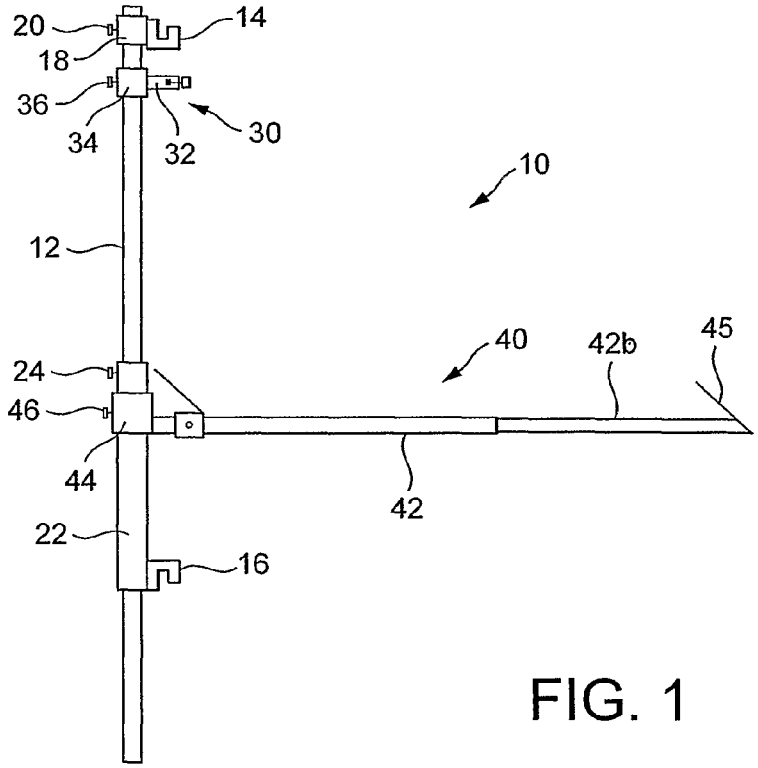
FIG. 1 is a side view of a support apparatus in accordance with the invention.

Referring to FIGS. 1 to 4 of the drawings, a support apparatus in accordance with a preferred embodiment of the invention is generally designated by the numeral 10. The support apparatus 10 comprises an elongate support member or rod 12 which in its in use position is oriented generally vertically with respect to a frame unit 52 (FIGS. 2 to 4) of a window assembly 50. The support member 12 has first and second clamp elements 14, 16 by which it is clamped to the frame unit 52 as will be more fully explained hereinafter. The first clamp element 14 is located adjacent an upper end of the support member 12 with the second clamp element being located at a position towards a lower end of said member 12.

The first clamp element 14 is carried on a first collar 18 which is slidably mounted on the support member 12. The collar 18 has means in the form of a thumbscrew 20, for example, for locking it at a position on the support member 12 selected by a user, although any suitable means familiar to a skilled artisan for locking the collar 18 at a selected position on the member 12 may be used as an alternative to the thumbscrew 20. The second clamp element 16 is, in a similar manner to the first element 14, carried on a second collar 22 which is also slidably mounted on the support member 12 and which also includes a thumbscrew 24 or the like for locking it at a position on the member 12 selected by the user. The first and second clamp elements 14, 16 each comprise a generally C shaped member in section and these are arranged on their respective collars 18, 22 such that they, in use, each engage a respective portion of an inner peripheral lip 52*a* (FIG. 2) of the frame unit 52.

Figure 2:
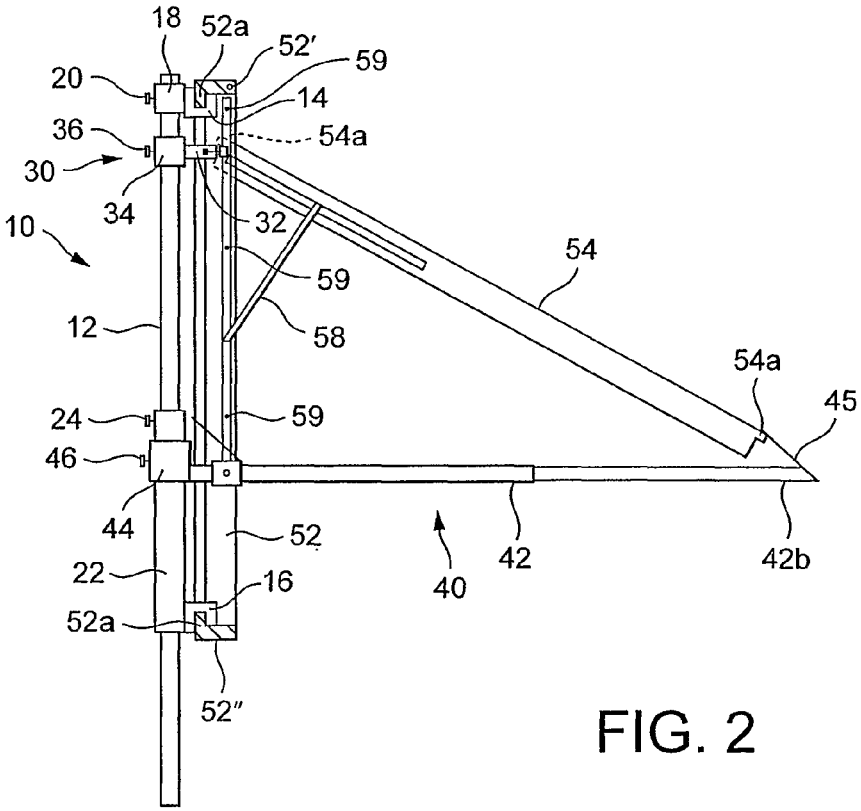
FIG. 2 is a side view of the support apparatus of FIG. 1 clamped to a frame unit of a window assembly.
Figure 3:
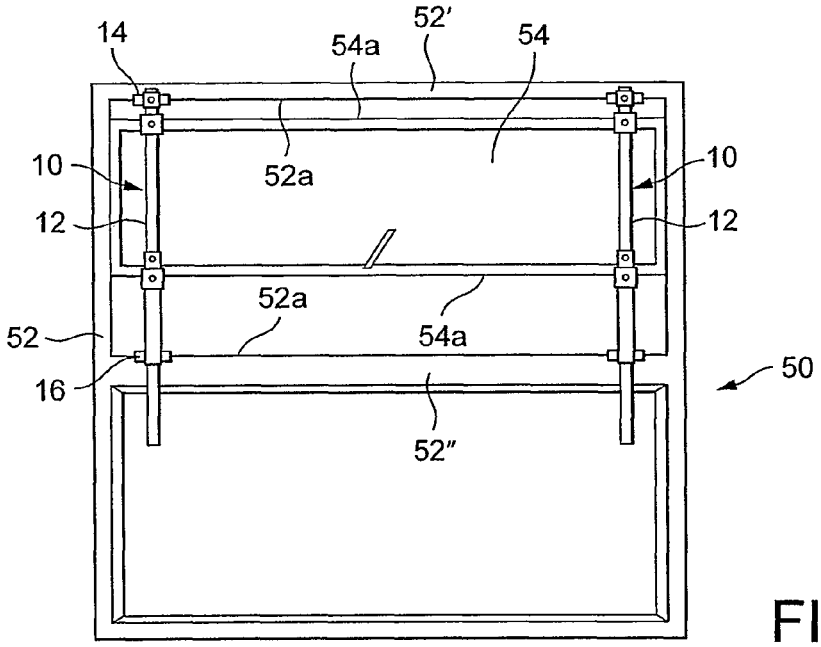
FIG. 3 is a view from behind of a pair of the support apparatuses of FIG. 1 clamped on respective sides of a frame unit of a window assembly.
Figure 4:
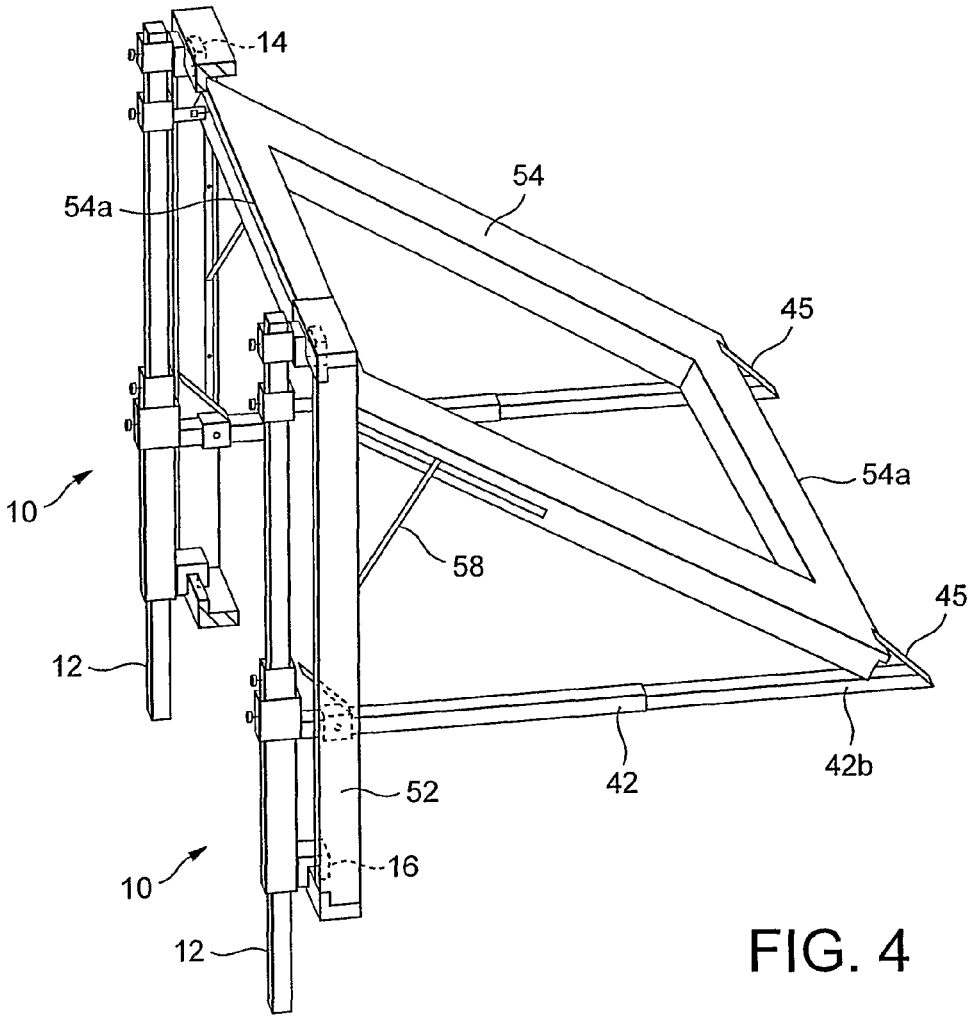
FIG. 4 is a side perspective view of an upper portion of a window assembly with a pair of the support apparatuses of FIG. 1 clamped to respective sides thereof.

In order to clamp the support apparatus 10 to the frame unit 52, the user firstly moves a window sash 54 to an open position relative to the frame unit as illustrated in FIGS. 2 to 4. In this position, the sash 54 is supported by mechanical linkages 58 (FIGS. 2 and 4) that are connected in a known manner between upper portions of the sides of the sash 54 and the sides of the frame unit 52. The linkages 58 are normally secured to side frame unit sides by screws 59 (see FIG. 2). The user then selects an appropriate position on the support member 12 at which to lock the first collar 18 and thus the first C-shaped clamp element 14. The user then places the support apparatus 10 in a generally vertical orientation adjacent to the frame unit 52 such that said first C-shaped clamp element 14 is engaged with its respective portion of the lip 52*a* of the frame unit 52 in a top frame section 52' thereof. Whilst holding the support apparatus 10 in this position, the user adjusts the position of the second collar 22 on the support member 12 such that the second C-shaped clamp element 16 can be engaged with its respective portion of the peripheral lip 52*a* in a bottom frame section 52" of the window assembly frame unit 52. The user then locks the second collar 22 at the selected position on the support member 12 thereby clamping the support apparatus 10 to the frame unit 52 through the engagement of the first and second clamp elements 14, 16 with their respective portions of the peripheral lip 52*a* of the frame unit 52.

The support member 12 is preferably formed from a tubular steel material for a combination of strength and lightness, although the member 12 may be formed from any suitable tubular or other material. The support member 12 preferably has a circular cross-section but may take any cross-sectional shape.

It will be appreciated that the clamping procedure described above may be performed in what might be considered a reverse mode whereby the user firstly locks the second collar 22 at a selected position on the member 12, locates the second clamp element 16 over its respective lower portion of the lip 52*a* and then raises the first clamp element 14 to engage it with its respective top portion of the lip 52*a* and then locks the first collar 18 to the member 12 at this position thereby clamping the support apparatus 10 to the frame unit 52.

It will also be appreciated that only one of the first and second collars 18, 22 need be slidably mounted on the support member 12 in order to clamp the support apparatus 10 to the window assembly frame unit 52 through engagement of the clamp elements 14, 16 with respective portions of the inner peripheral lip 52*a* of the frame unit 52. However, the feature of the preferred embodiment of the invention that each of the first and second collars 18, 22 is slidably mounted to the support member 12 increases the versatility of the support apparatus clamping procedure particularly for installed window assemblies having a top frame section that is located close to a ceiling or a bottom section located close to a floor, for example.

It will be also be appreciated that the means for clamping the support apparatus 10 to a window assembly frame unit could take any suitable form other than that already described. Suitable arrangements might include a pneumatic or hydraulic cylinder arrangement or a spring loaded telescoping pole arrangement whereby the ends of said cylinder or pole are braced against respective top and bottom or even side frame sections of the frame unit 52.

The support apparatus 10 includes a first window sash engagement means 30 located on the support member 12 generally adjacent but below the first clamp element 14. The first window sash engagement means 30 comprises a spigot 32 extending generally horizontally from a collar 34. The collar 34 is slidably mounted to the support member 12 and includes a thumbscrew 36 or the like for locking the collar 34 at a selected position on the member 34. The spigot 32, in use, supports a window sash 54 of the window assembly 50 by engaging the underside of a circumferential lip 54*a* of a top frame section of the sash 54.

A second window sash engagement means 40 of the support apparatus 10 comprises an arm 42 extending generally horizontally from a further collar 44. The collar 44 is slidably mounted on the second collar 22 which has a depth considerably greater than that of the first collar 18. The further collar 44 also has a thumbscrew 46 or the like for locking it at a selected position relative to the second collar 22 and by consequence the support member 12. In an alternative embodiment (not shown) the further collar carrying the arm 42 is slidably mounted on the support member 12.

The first and second window sash engagement means 30, 40 between them comprise a window sash support means of the support apparatus 10 with the arm 42 comprising a support platform part of said support means.

Whilst it is possible to remove a window sash 54 from a window assembly using only one of the support apparatuses 10 as hereinbefore described, in a preferred window sash removal procedure as will now be described, two support apparatuses 10 are employed as illustrated in FIGS. 3 and 4, said support apparatuses 10 being clamped to the frame unit 52 with one to each side thereof.

Once the support apparatuses 10 have been clamped to the frame unit 52 as illustrated, the collars 34 carrying the spigots 32 are adjusted so that each spigot sits under and in contact with a respective portion of the circumferential lip 54*a* of the sash 54. The collars 34 are then locked to their respective support members 12 at the corresponding positions. The arms 42 of each support apparatus 10 are then raised so that a bottom frame section of the sash 54 is resting on outer ends 42*b* thereof. Each of the arms 42 may include an inclined retaining plate 45 at its outer end 42*b* which holds said bottom frame section of the sash 54. The collars 44 supporting the arms 42 are then locked to the support member 12. Consequently, the window sash 54 is now being supported by both the mechanical linkages 58 and the support means comprising the spigots 32 and arms 42.

With the sash 54 in its open position yielding access to the mechanical linkages 58 and being supported by the support means 32, 42, the user can release (unscrew) the linkages 58 from the frame unit (or sash frame) thus releasing the sash 54 from the frame unit 52. The user can then lift the sash from the support means 54 in readiness for a replacement sash to be installed.

Rather than the user lifting the released sash 54 from the support means 32, 42 in the position it occupies on the support means as illustrated in FIGS. 2 to 4, in a preferred procedure in accordance with the invention, the sash 54 is lowered onto the platform part 42 of the support means 32,42 comprising the arms 42 by simultaneously unlocking the collars 34 and controlling said collars 34 to slide down their respective support members 12 until the sash 54 is lying generally flat on the arms 42. The arms 42 may be extendible to accommodate the length (depth normal to the width of the frame unit) of the sash as it is lowered. In this position, the sash 54 can be more easily lifted from the arms 42. This is particularly true where the user is on an interior side of the window assembly 50 which comprises the area to the left of the support apparatuses 10 as viewed in FIG. 4. In this case, the user can lift the sash 54 from its position resting on the arms 42, rotate it slightly so that if can pass diagonally through the frame unit opening normally closed by the sash 54.

It will be appreciated from the foregoing not only that the user can operate the support apparatuses 10 exclusively from the interior side of an installed window assembly but that the apparatuses 10 enable a single user to perform a sash removal operation.

To install a replacement sash 54, a generally reverse procedure is adopted whereby, with the support apparatuses 10 clamped to the frame unit 52, the user passes the replacement sash 54 out through the frame opening for the sash and rests it on the arms 42 with its upper edge innermost to the frame unit. The user then engages the spigots 32 with the underside of the sash frame lip 54*a* and then raises the collars 34 to a position coincident with an open position of the sash 54 relative to the frame unit 52. The arms 42 may comprise spring-biased telescopic arrangements whereby, as the collars 34 are raised, the arms retract to accommodate the general inward movement of the bottom part of the sash 54 thereby assisting the user in positioning the sash 54 at its open, position. Once in its open position, the sash can be connected to the frame unit by securing the mechanical linkages 58 between the sides of the sash frame and sides of the frame unit, as appropriate. The support apparatuses 10 can then be removed. The sash installation procedure can also be conducted entirely from an interior side of the window assembly 50 by a single user.

The invention claimed is:

1. A method of removing a window sash from a window assembly, comprising the steps of:

clamping a support apparatus to a frame unit of the window assembly, said support apparatus having means for supporting a window sash in an open position relative to the frame unit;

adjusting the support means to support the window sash in said open position;

releasing mounting means by which the window sash is mounted to the frame unit; and removing the window sash from the support means, wherein the support apparatus comprises an elongate support member which, when in use, clamps by a clamp to said frame unit of said window assembly in a generally vertical orientation, said clamp comprises a first clamp element and a second clamp element, each of said clamp elements being slidably mounted to said elongate support member, at least one clamp element comprises a C-section member for engaging a peripheral lip part of said window assembly frame unit.

2. A method as claimed in claim 1, wherein it includes the step of lowering the released window sash onto a platform part of the support means prior to the step of removing the window sash from said support means.

3. A method as claimed in claim 1, wherein it includes clamping separate support apparatuses on either side of the window assembly frame unit and operating the support apparatuses simultaneously to remove the window sash from the window assembly.

4. A method of installing a window sash in a window assembly, comprising the steps of:

clamping a support apparatus to a frame unit of the window assembly, said support apparatus having means for supporting a window sash;

placing a window sash on said support means;

adjusting the support means to support the window sash in an open position relative to the frame unit; and securing mounting means between the window sash and frame unit, wherein the support apparatus comprises an elongate support member which, when in use, clamps by clamp to said frame unit of said window assembly in a generally vertical orientation, said claim comprises a first clamp element and a second clamp element, each of said clamp elements being slidably mounted to said elongate support member, at least one clamp element comprises a C-section member for engaging a peripheral lip part of said window assembly frame unit.

5. A method as claimed in claim 4, wherein it includes the step of readjusting the support means to no longer support the window sash prior to removing the support apparatus from the window assembly frame unit.

6. A method as claimed in claim 4, wherein the step of adjusting the support means includes raising the window sash from a platform part of the support means prior to the step of securing the mounting means between the window sash and frame unit.

7. A method as claimed in claim 4, wherein it includes clamping separate support apparatuses on either side of the window assembly frame unit and operating the support apparatuses simultaneously to install the window sash in the window assembly.

* * * * *